US005390984A

United States Patent [19]

Boucherie et al.

[11] Patent Number: 5,390,984

[45] Date of Patent: Feb. 21, 1995

[54] METHOD OF PRODUCING TOOTH BRUSHES

[75] Inventors: Leonel P. Boucherie; Bart G. Boucherie, both of Izegem, Belgium

[73] Assignee: G. B. Boucherie N.V., Izegem, Belgium

[21] Appl. No.: 170,201

[22] PCT Filed: Apr. 28, 1993

[86] PCT No.: PCT/EP93/01025

§ 371 Date: Dec. 22, 1993

§ 102(e) Date: Dec. 22, 1993

[87] PCT Pub. No.: WO93/21796

PCT Pub. Date: Nov. 11, 1993

[30] Foreign Application Priority Data

Apr. 28, 1992 [EP] European Pat. Off. ..... 92107205

[51] Int. Cl.[6] ..... A46D 3/04

[52] U.S. Cl. ..... 300/21

[58] Field of Search ..... 300/21, 10, 5

[56] References Cited

U.S. PATENT DOCUMENTS

| | | | |
|---|---|---|---|
| 3,260,549 | 7/1966 | Guey et al. | 300/5 |
| 3,836,199 | 9/1974 | Blankschein | 300/21 |
| 4,114,221 | 9/1978 | Enchelmaier | 15/182 |
| 4,348,060 | 9/1982 | Lewis, Jr. | 300/21 |
| 4,696,519 | 9/1987 | Lewis, Jr. | 300/7 |
| 4,892,698 | 1/1990 | Weihrauch | 264/243 |
| 4,979,782 | 9/1990 | Weihrauch | 300/4 |
| 5,033,797 | 7/1991 | Rueb | 500/5 |

FOREIGN PATENT DOCUMENTS

| | | | |
|---|---|---|---|
| 0568055 | 11/1993 | European Pat. Off. | 300/21 |

*Primary Examiner*—John Husar

*Attorney, Agent, or Firm*—Sixbey, Friedman, Leedom & Ferguson; Gerald J. Ferguson, Jr.

[57] ABSTRACT

Individual tufts of bristles are picked from a supply of pre-cut bristles having rounded utilization-side ends and transferred to a vise. The vise has a number of through holes arranged in a pattern corresponding to that of the tufts on the finished tooth brushes. While tufts of bristles are held in the through holes of the vise with their ends projecting on both sides, a die member having a profiled face is advanced into engagement with the ends of the bristles to move them axially through the holes of the vise and with respect to each other until both ends of the bristles are aligned in parallel planes corresponding in shape to that of the profiled face. The tufts of bristles are now clamped in the vise and transferred to the brush body head to be implanted therein.

12 Claims, 2 Drawing Sheets

METHOD OF PRODUCING TOOTH BRUSHES

The present invention relates to a method of producing tooth brushes with particular profiles of the tufts implanted in the head of the brush body.

After tufts of bristles have been implanted in the head portion of a brush body in conventional manner, the ends of the bristles can be trimmed to provide a desired profile different from a configuration wherein the ends of the bristles are aligned in a common plane. After the trimming of bristles, their ends are rounded to eliminate sharp edges. Such trimming and rounding of the bristle ends are additional finishing operations complicating the production of the tooth brushes and adding to the production costs.

The present invention provides a method of producing tooth brushes with particular desired profiles of tufts wherein the finishing steps of trimming and rounding of the bristle ends are eliminated.

More specifically, the present invention provides a method of producing tooth brushes wherein base members having through holes arranged in a pattern corresponding to the desired pattern of bristle tufts are provided and individual tufts of bristles to be implanted in these holes are picked from a supply of pre-cut bristles of equal length and having rounded utilization-side ends. Before their introduction into the holes of the base member, the tufts of bristles are introduced into through holes of a vise which are arranged in a pattern corresponding to that of the base member. Each hole of the vise is associated with clamping means for releasably clamping a tuft of bristles inserted therein. The ends of the bristles project from both sides of the vise. While the clamping means of the vise are in a released state, a die member having a profiled face is advanced with its face into engagement with the projecting ends of the bristles to push the bristles axially within the through holes, so that both ends of the bristles are aligned in parallel surfaces corresponding in shape to the profiled face. The clamping means are then engaged to hold the bristles in the vise while their ends are in an aligned state. The base ends of the bristles are then introduced into the holes of the base member. After the base ends of the bristles have been affixed to the base member, the clamping means of the vise are released, and the base member with the bristles attached thereto is removed from the vise. The base member with the bristles affixed thereto may then be further processed to yield a finished tooth brush. In a first embodiment, the base member is a brush body head having a recess in its rear face, the base ends of the bristles extending into this recess, and the recess is closed with a cover plate or filled with a molding material.

In another embodiment, the base member is a base plate adapted to be mounted in a recess of a brush body head. In another embodiment, the vise is part of one of the members of an injection mould delimiting a cavity wherein a brush body is moulded. In this embodiment, plastic material is injected around the base ends of the bristles.

According to a preferred embodiment, a counter-die member having a profiled face complementary to that of the die member is used, and the counter-die member is moved with its profiled face into engagement with those ends of the bristles opposite the ends engaged by the profiled face of the die member. The counter-die member is used to stop actual movement of the bristles pushed by the die member so that the bristle ends will be precisely aligned in a surface having the desired profile and configuration.

The supply of pre-cut and rounded fibers or bristles may be similar to that used in conventional tooth brush filling mechanisms, but the utilization-side ends of the bristles should be rounded so that a separate rounding step after implantation of the bristle tufts in the brush body head is avoided.

In order to pick individual tufts of bristles from the supply, a picking tube is used in the preferred embodiment. The picking tube has an internal channel corresponding in cross section to a desired cross-sectional shape of the bristle tufts. When the picking tube penetrates into the supply of bristles, a tuft of bristles is retained in its internal channel, and when the picking tube is removed from the supply, the tuft is entrained so that it can be transferred to the vise to be inserted into one of its through holes.

In a preferred embodiment the clamping means comprises a resilient sleeve member for each of the through holes of the vise. The sleeve member has a conical outer surface. A cam member with a conical opening, complementary in shape to the conical outer surface of the sleeve is used to control the clamping and released states of the sleeve member by moving the cam member and sleeve axially with respect to each other. A plurality of cam members is formed in a common cam plate. Likewise, a plurality of sleeve members are mounted in a common carrier plate.

The method of producing tooth brushes will now be further described with reference to the accompanying drawings, wherein:

FIG. 1 schematically shows a supply of pre-cut and pre-rounded bristles and a picking tube for picking individual tufts of bristles from the supply;

Figure 6A:
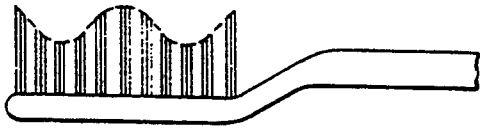
Figure 6B:
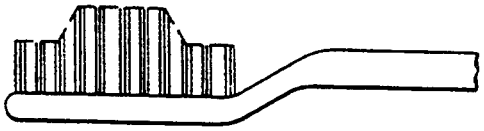
Figure 6C:
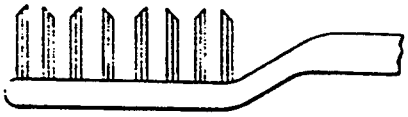
Figure 7:
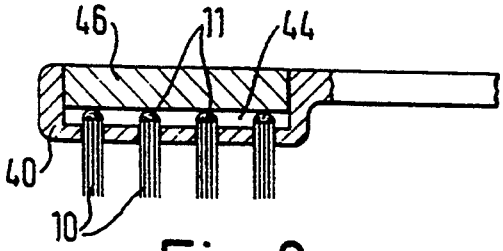
Figure 8:
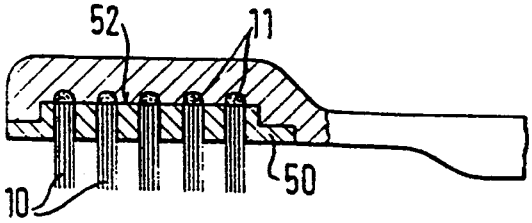

FIG. 6*a*, 6*b*, 6*c* show different profiles of tooth brushes which may be produced with the method of the invention;

FIG. 7 illustrates the step of fixing tufts of bristles in the brush body head; and FIG. 8 illustrates an alternative step of mounting a base member with tufts of bristles in a brush body head.

Figure 1:
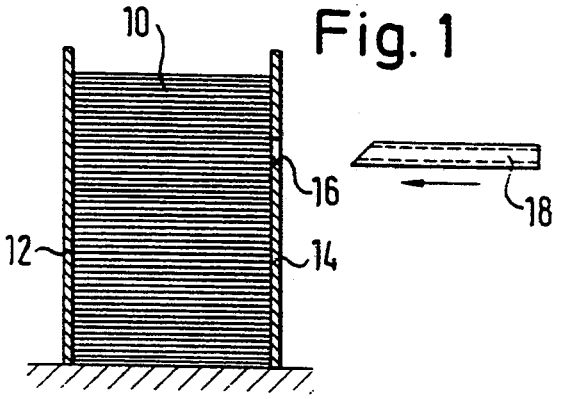
Figure 2:
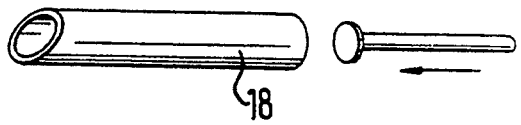
FIG. 2 shows a prospective view of the picking tube on an enlarged scale.

As shown in FIG. 1, a supply of pre-cut bristles 10 are aligned in parallel relationship between two opposed parallel walls 12, 14 in a packed and radially compressed state, as suggested by an arrow P. The bristles 10 are rounded on the utilization-side end. The wall 14 is provided with a hole 16. A picking tube 18 having an internal channel therein is provided for removing individual tufts of bristles 10 from the supply. The picking tube 18 is moved through the hole 16 and penetrates into the supply of bristles 10. A tuft of bristles is enganged in the internal channel of the picking tube 18 and entrained with the picking tube when the latter is removed from the supply.

The tufts of bristles 10 engaged in a plurality of picking tubes 18 are then transferred to a vise which has a plurality of through holes arranged in a pattern corresponding to that of the tufts on the finished tooth brush.

Figure 3:
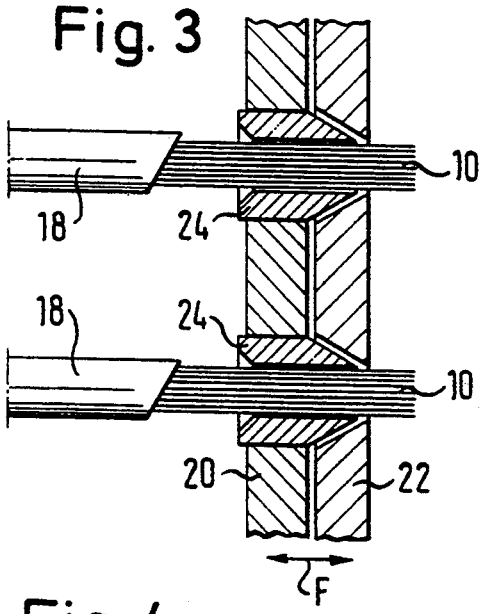
FIG. 3 shows a schematic sectional view of a vise.

As shown in FIG. 3, the vise comprises a carrier plate 20 and a cam plate 22. The carrier plate 20 has a sleeve member 24 mounted in each of its through holes. The sleeve member 24 has a slit conical portion projecting from the carrier plate 20 in the direction of the cam plate 22. The cam plate 22 is provided with a plurality of conically shaped openings for cooperation with the correspondingly shaped conical portion of the sleeve members 24. As indicated by an arrow F in FIG. 3, the carrier plate 20 and cam plate 22 are adapted to be moved with respect to each other so that the conical portions of the sleeve members 24 are controlled by the cam plate 20 to clamp a tuft of bristles 10 introduced through the internal bore of each sleeve member 24 when the carrier plate 20 and cam plate 22 are close to each other and to release the tuft of bristles when the plates are spaced from each other.

After tufts of bristles have been introduced in the through holes of the vise, as shown in FIG. 3, the carrier plate 20 and cam plate 22 are approached to each other so that the tufts are safely clamped therein. The picking tubes 18 can now be withdrawn. In this condition, the tufts of bristles 10 project from both sides of plates 20, 22.

Figure 4:
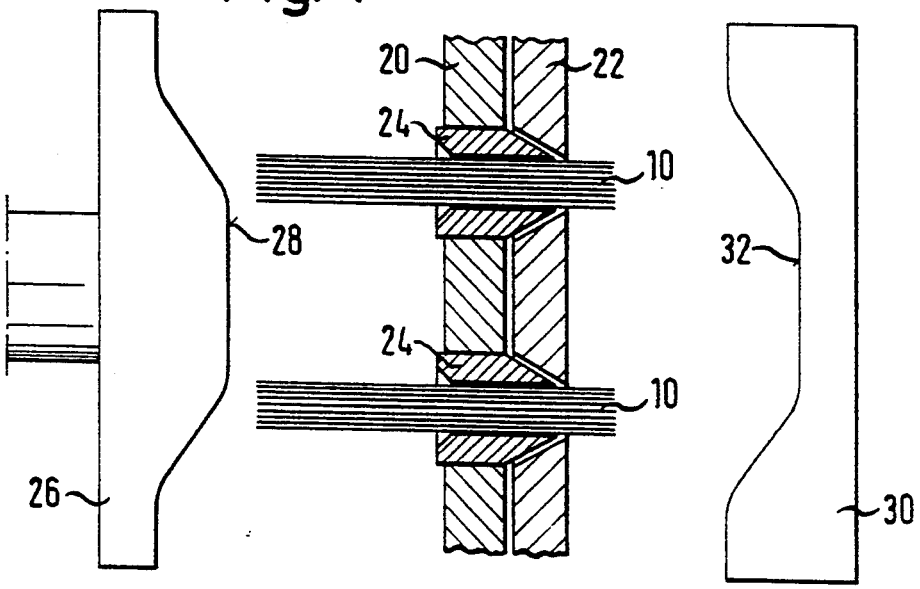
FIG. 4 shows a schematic view illustrating the step of axially moving bristles held in the vise of FIG. 3 by engagement with a die member.

The next step shown in FIG. 4 consists in slightly releasing the tufts of bristles held in the vise by slightly withdrawing cam plate 22 from carrier plate 20, and advancing a die member 26 against the adjacent ends of the bristles held in the vise. As seen in FIG. 4, the die 26 has a profiled surface 28 which corresponds to the desired profile of the tufts on the tooth brushes to be produced. By advancing the die 26 its profiled face 28 engages the ends of the bristles 10, whereby the bristles are axially moved through the vise and with respect to each other until both ends of the bristles are aligned in parallel surfaces corresponding in shape to that of the profiled face 28. As further seen in FIG. 4, a counter-die 30 is provided which has a profiled face 32, corresponding in shape to that of the profiled face 28 of die 26. By pushing the bristles 10 until they abut the profiled face 32 of counter-die member 30, the bristles are precisely aligned in the desired configuration.

Figure 5:
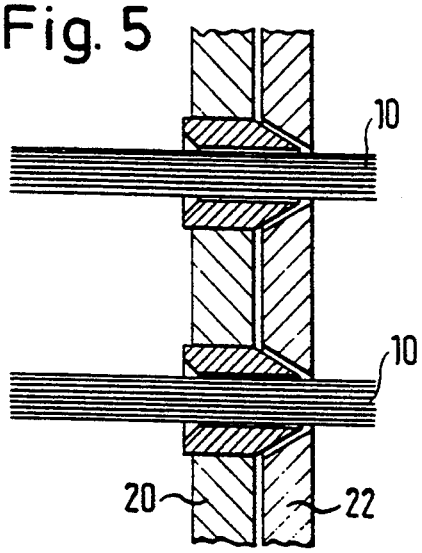
FIG. 5 illustrates the step of transferring profiled tufts of bristles held in the vise to the brush body head.
Figure 5:
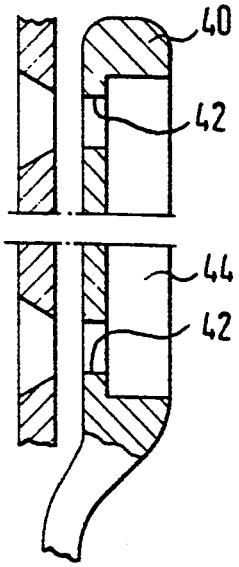

In this condition, as shown in FIG. 5, the tufts of bristles 10 are again clamped in the vise so that they can be safely transferred to a base member 40 which, in the embodiment shown in FIG. 5, is the head portion of a tooth brush body. This base member 40 is provided with a number of holes 42 arranged in a pattern corresponding to that of the tufts of bristles on the finished tooth brush. The tufts of bristles 10 are now introduced into these holes 42 of the base member 40 so that the base ends of the bristles extend into a recess 44 formed on the rear side of the base member 40 in the head portion of the tooth brush body. To affix the tufts of bristles to the base member 40, their base ends can be fused in conventional manner, as shown at 11 in FIG. 7, and the recess 44 is then closed with a plate member 46. Alternatively, the recess 44 is filled with a molding material.

In the embodiment of FIG. 8, the base member 50 is a plate adapted to be mounted in a recess 52 on the front side of the brush body head portion.

In still another embodiment, the cam plate 22 of the vise is part of one of the members of an injection mould which delimits a cavity wherein a brush body or base member 40 is moulded. In this embodiment, plastic material is moulded around the base ends of the bristles. It may be convenient to fuse the base ends of the bristles together in conventional manner before the injection step.

FIGS. 6*a*, 6*b*, 6*c* show only three among the multiplicity of possible tuft profiles and configurations the inventive method permits to be produced. Depending on the particular profile to be produced, it may be required to trim the base ends of the configured tufts before they are affixed to the base member.

It is readily apparent that generally flat tuft profiles can be achieved with the inventive method as well, if the die 26 is provided with a correspondingly flat "profiled" surface 28.

We claim:

1. A method of producing tooth brushes, comprising the steps of:

a) providing a base member for each brush to be produced, said base member having a front face and a rear face and a plurality of holes passing between said front and rear faces and arranged in a pattern corresponding to a pattern of bristle tufts to be implanted in said base member;

b) providing a supply of pre-cut bristles of equal length in an axially aligned and radially compressed state wherein each bristle has a rounded end and an opposed base end;

c) providing a vise having a number of through holes arranged in a pattern corresponding to that of said base member, each through hole being associated with clamping means for releasably clamping a tuft of bristles inserted therein;

d) picking individual tufts of bristles from said supply and introducing each tuft into one of said through holes of said vise, said clamping means being in a released state, and at least one of said bristle ends projecting from said through holes;

e) providing a die member having a profiled face and simultaneously engaging said projecting ends with said profiled face to push said bristles axially within said through holes so that both bristle ends are aligned in parallel surfaces corresponding in shape to said profiled face;

f) engaging said clamping means to hold said bristles in said vise while their ends are in an aligned state;

g) introducing the base ends of said bristles into the holes of said base member, trimming the base ends of said bristles and affixing the bristles to said base member;

h) releasing said clamping means of said vise; and i) withdrawing the bristles from the through holes of said vise.

2. The method of claim 1, wherein step e) comprises providing a counter-die member having a profiled face complementary to that of said die member, both of said bristle ends projecting from said through holes of said vise, and engaging one of said bristle ends with the profiled face of said die member and simultaneously the other of said bristle ends with said face of the counter-die member.

3. The method of claim 1, wherein step d) comprises providing a picking tube with an internal channel corresponding in cross section to a desired cross-sectional shape of said bristle tufts, penetrating with said picking tube into said supply of bristles, removing said picking tube from said supply of bristles and entraining a tuft of bristles engaged in said channel, introducing said entrained tuft of bristles into one of said through holes of said vise, engaging said clamping means of said vise and removing said picking tube from said vise.

4. The method of claim 3, wherein a piston member is used to assist introduction of said tuft of bristles from said channel into said through hole of the vise.

5. The method of claim 1, wherein said clamping means comprises a slit resilient sleeve member with a conical outer surface for each of said through holes and a cam member with a conical opening complementary in shape to said conical outer surface, said sleeve member and said cam member being axially movable with respect to each other.

6. The method of claim 5, wherein a plurality of said cam members is formed in a common cam plate.

7. The method of claim 5, wherein a plurality of said sleeve members are mounted in a common carrier plate.

8. The method of claim 1, wherein said base member is a brush body head having a recess in said rear face, said base ends of the bristles extending into said recess, and said recess being closed with a cover plate or filled with a molding material.

9. The method of claim 8, wherein each tuft of bristles is formed with a head portion connecting together the bristles of each tuft and retaining said tuft on said base member.

10. The method of claim 1, wherein said base member is a base plate adapted to be mounted in a recess of a brush body head.

11. The method of any of claim 1, wherein said vise forms part of one of the members of an injection mould delimiting a mould cavity wherein a brush body is moulded.

12. The method of claim 11, wherein said base ends of the bristles are fused together prior to the step of moulding of the brush body.

* * * * *